US005273555A

United States Patent [19]

DeCarlo

[11] Patent Number: 5,273,555

[45] Date of Patent: Dec. 28, 1993

[54] PREPACKAGED FUEL HOLDER AND FIRE PAN FOR PICNIC COOKING

[76] Inventor: Donald J. DeCarlo, P.O. Box 152, Tarrytown, N.Y. 10591

[21] Appl. No.: 956,099

[22] Filed: Oct. 2, 1992

[51] Int. Cl.[5] ..... C10L 5/00

[52] U.S. Cl. ..... 44/540

[58] Field of Search ..... 44/540

[56] References Cited

U.S. PATENT DOCUMENTS

| | | | |
|---|---|---|---|
| 2,965,096 | 12/1960 | Barton | 44/540 |
| 3,123,062 | 3/1964 | Psarris | 44/540 |
| 3,279,453 | 10/1966 | Norehead et al. | 44/540 |
| 3,385,282 | 5/1968 | Lloyd | 44/540 |
| 4,094,649 | 6/1978 | Osterried | 44/540 |
| 4,102,317 | 7/1978 | Shonnard et al. | 44/540 |
| 4,175,925 | 11/1979 | Paek et al. | 44/540 |
| 4,257,387 | 3/1981 | Storandt | 44/540 |
| 5,179,932 | 1/1993 | DeCarlo | 126/9 R |

*Primary Examiner*—Margaret Medley

[57] ABSTRACT

Prepackaged fuel holder and fine pan for picnic cooking comprises a body portion having at least one recess therein for receiving a fuel, as for example, charcoal briquettes. A plurality of spaced wires extend across the recess to facilitate moving the fuel holder and fire pan when it becomes too hot from use to be handled. Also, a removable, flat cover is disposed over the recess to retain the fuel in the recess and permit stacking of a plurality of fuel holder and fire pans for marketing purposes. In another embodiment the fuel holder and fire pan has a perforated floor to form a false bottom and a chamber in the recess. The chamber functions to receive ash and provide combustion air upwardly around the fuel.

12 Claims, 2 Drawing Sheets

PREPACKAGED FUEL HOLDER AND FIRE PAN FOR PICNIC COOKING

This invention relates to a prepackaged fuel holder and fire pan for picnic cooking and, more particularly, to a prepackaged fuel holder/fire pan which is useable with picnic cook-stoves, barbeques and outdoor cooking in general.

BACKGROUND OF THE INVENTION

Heretofore, picnic cook-stoves, whether collapsible or not, had fire pans forming an integral part of the cook-stove assembly. These fire pans required the addition thereto of fuel, such as charcoal briquettes, when the cook-stove was ready to be used. The fuel would be supplied to the fire pan from a separate source, such as bag or box of charcoal briquettes. The fire pan would also have to be cleaned, at least, from time to time prior to further use. In the case of picnic cook-stoves of the collapsible type having an integral fire pan the necessity for carrying a bag of charcoal which might be in excess of the amount of the anticipated fuel needs, was undersirable because of the extra weight and bulk involved, particularly for hikers and campers. Also, for hikers and campers it is desirable to be able to dispose of the fire pan after use to reduce the load to be carried after use of the cook-stove. The combustible fuel package shown in the U.S. patent to Witt, U.S. Pat. No. 4,953,533 is not only disposable but it is consumed in use. Since it is consumed in use, it can only be used once and only where the cook-stove has an integral fire pan or used in a barbecue pit or fireplace. It is therefore not suitable for collapsible picnic cook-stoves, such as disclosed in applicant's copending patent application, Ser. No. 892,795, filed Jun. 2, 1992 and now U.S. Pat. No. 5,179,932. The prepackaged fuel holder and fire pan of this invention overcomes all of the aforesaid problems of heretofore known prior art devices.

It is, therefore, an object of this invention to provide a prepackaged fuel holder and fire pan for picnic cooking, which is suitable for use in collapsible cook-stoves and can be conveniently marketed and easily carried until ready for use. Another object of this invention is to provide a fuel holder and fire pan that is relatively inexpensive to manufacture and may be disposable or reused with the addition of fresh fuel. A further object of this invention is to provide a fuel holder and fire pan that provides effective heat for cooking, keeps the user out of contact with fuel until ready for use, and is safe and easy to use.

SUMMARY OF THE INVENTION

The prepackaged fuel holder and fire pan for picnic cooking comprises, in general, a body portion having at least one recess for receiving fuel therein, which recess is defined by a bottom wall and a contiguous side wall means. Also means is provided to permit a user to move the fuel holder and fire pan when the latter is too hot to handle.

In another embodiment of the invention, the prepackaged fuel holder and fire pan for picnic cooking comprises, in general, a body portion having at least one recess for receiving fuel therein, which recess is defined by a bottom wall and contiguous peripheral wall means. A floor means is disposed in the recess in spaced relationship with said bottom wall for supporting fuel in said recess and to form a chamber with the bottom wall.

The floor means has a planar surface portion includes a plurality of perforations communicating with the chamber to provide air circulation therethrough and around the fuel for supporting improved combustion of the fuel and ash, from the burning fuel, to enter the chamber.

One feature of this invention according to one embodiment, is a floor means consisting of a thin perforated plate supported in spaced, substantial parallelism with the bottom wall of the recess by a plurality of circumferentially spaced legs depending from the peripheral portion of the plate. alternatively, the perforated plate, instead of having a plurality of legs, may be supported in spaced parallelism with the bottom wall of the recess by a plurality of spaced dimples in the peripheral wall means extending into the recess.

Another feature of this invention is a cover or lid for sealing the open portion of the recess to retain the fuel in the recess. This cover is removable when the fuel holder and fire pan is ready to be used. The cover also functions to permit easy stacking of a plurality of fuel holder and fire pan units for storage or marketing displays. Where the fuel is charcoal briquettes impregnated with ignition or starter fluid, the cover further functions to minimize vaporization of such fluid.

BRIEF DESCRIPTION OF THE DRAWINGS

This invention will be more fully understood from the following detailed description thereof when considered in connection with the accompanying drawing wherein several embodiments of the invention are illustrated by way of example, and in which.

DESCRIPTION OF THE PREFERRED EMBODIMENTS

Figure 1:
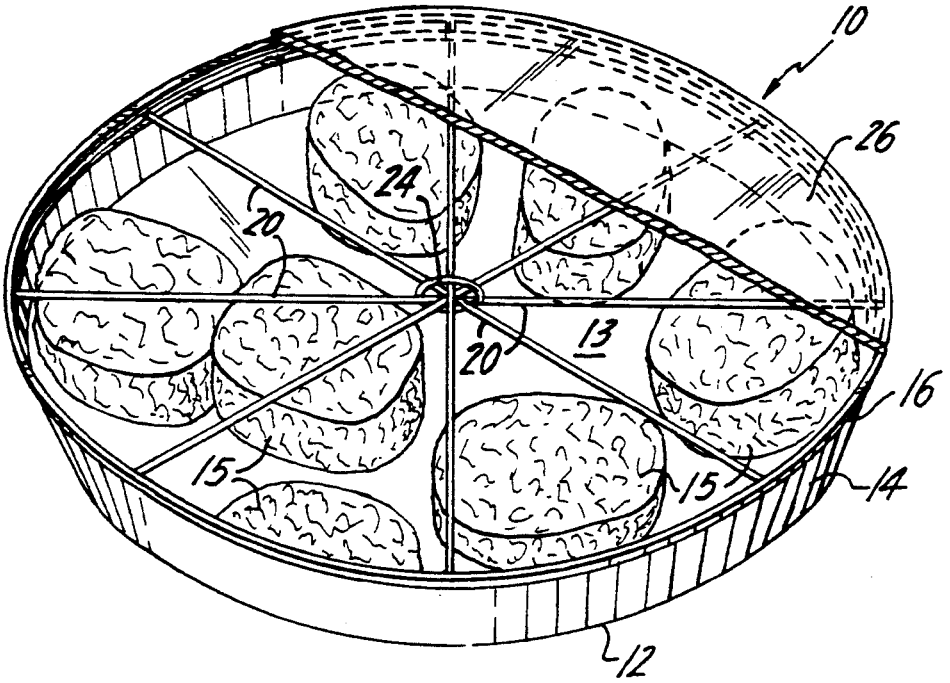
FIG. 1 is a perspective view of the fuel holder and fire pan assembly, according to a first embodiment of this invention with parts broken away for illustration purposes only.
Figure 2:
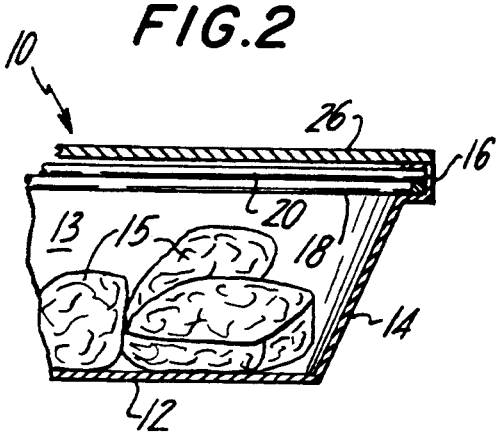
FIG. 2 is a fragmentary view in cross section of the fuel holder and fire pan shown in FIG. 1.

Now referring to the drawings and more particularly FIGS. 1 and 2, the reference number 10 designates a fuel holder and fire pan (hereinafter referred to as a "fuel holder") according to a first embodiment of this invention. The fuel holder 10 comprises a body portion having a bottom 12, and an annular side wall 14 which forms a recess 13 for receiving a fuel, such as charcoal briquettes 15. This body may be pie-pan shaped formed entirely of aluminum or be a laminated material having an inner surface of aluminum or other heat resistant and reflective material. The body, as shown, may have the side wall 14 tapered with an annular flange or lip portion 16, and, if the body is thin aluminum the lip portion may be reinforced by a wire ring 18 attached to the flange by a suitable heat resistant adhesive (see FIG. 2.). A plurality of wires 20 are disposed diametrically across the opening of the body and each is secured at their opposite ends to the ring 18 by welding or by other suitable securing means. As best shown in FIG. 2, flange 16 may be deformed to embrace wires 18 and 20. The wires 20 are tied together where they intersect by any suitable mean such as wire loop 24. The wires 18 enable the removal of the fuel holder 10 from its place of use such as the collapsible picnic cook-stove disclosed in the aforesaid copending patent application, (now U.S. Pat. No. 5,179,932), when the fuel holder 10 is still hot from use. The movement of the fuel holder 10 is facilitated by use of a suitable instrument, such as a button hook, which is positioned to engage loop 24. A disposable lid or cover 26 which may be made of cardboard is suitably secured to flange 16 to retain fuel, such is shown or, the fuel could be jellied alcohol. The cover 26 functions, where the fuel is charcoal, to retain the fuel in the recess 13 of fuel holder 10 and, if the briquette or other fuel has a flame accelerator, functions to prevent vaporization of the flame accelerator. The cover 25 is removed prior to the ignition of the fuel in fuel holder 10.

The fuel holder 10 is suitable for use in a picnic cook-stove disclosed in applicant's aforesaid copending application or other picnic cook-stoves (not shown) having integral fire pans. It even may be used in barbecue pits. In all of the varied uses of the fuel holder 10, it provides a convenient, clean and light-weight source of cooking heat.

Figure 3:
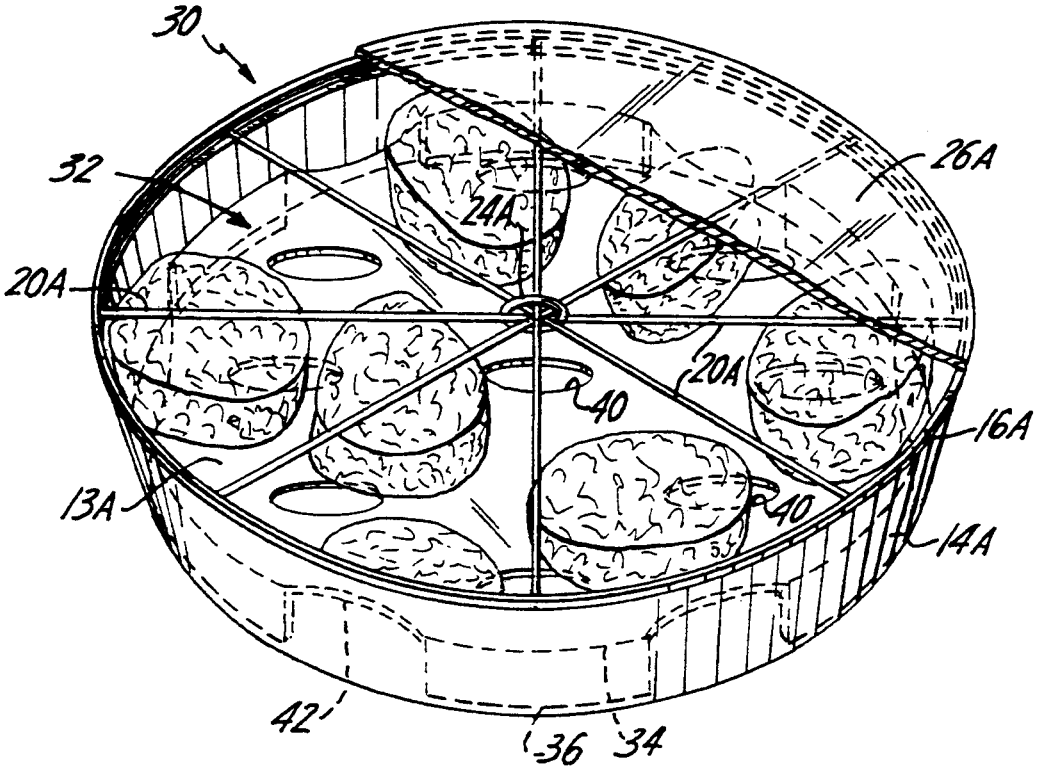
FIG. 3 is a perspective view of a fuel holder and fire pan assembly according to a second embodiment of this invention, with parts broken away for illustration purposes only.
Figure 5:
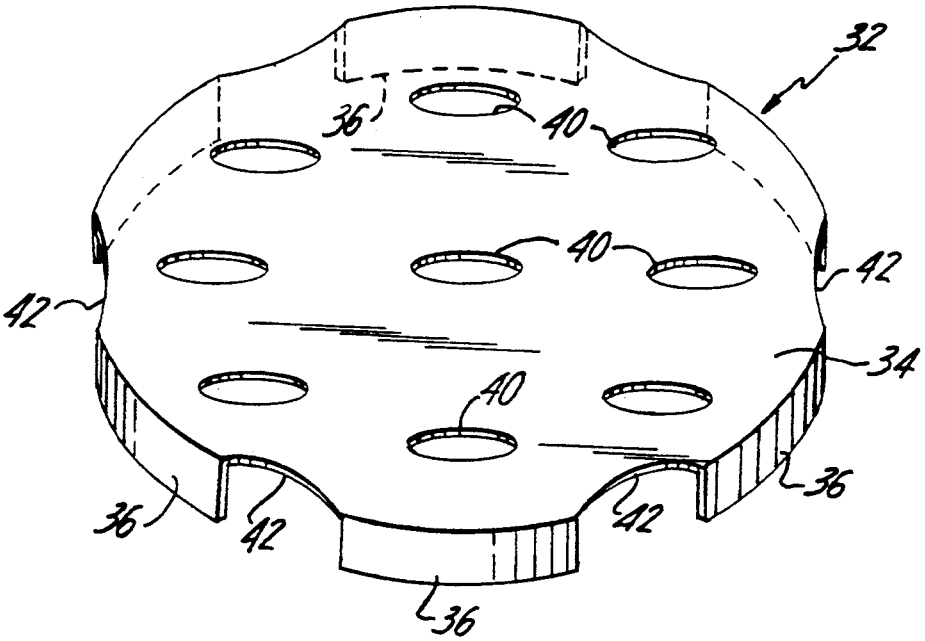
FIG. 5 is a perspective view of the floor forming the false bottom of the fuel holder and fire pan assembly shown in FIGS. 3 and 4.
Figure 4:
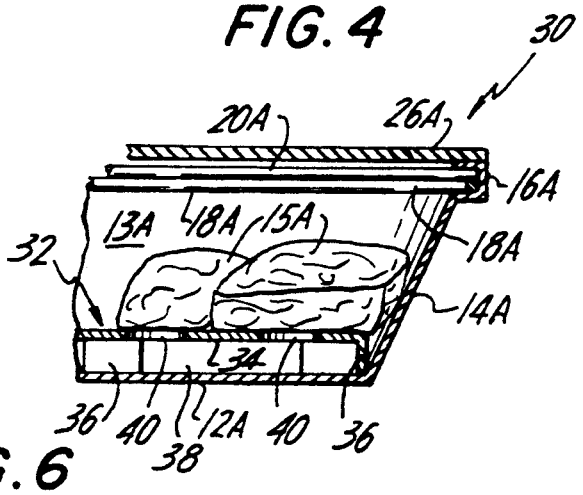
FIG. 4 is a fragmentary view in cross section of the fuel holder and fire pan shown in FIG. 3.

In FIGS. 3, 4 and 5 is shown a fuel holder and fire pan assembly 30 (hereinafter referred to as a fuel holder) according to a second embodiment of this invention. The fuel holder 30 essentially differs from fuel holder 10 in that it provides means for improved burning of the fuel and therefore, parts of fuel holder 30 will be designated by the same reference number as the like part of fuel holder 10, but with the suffix A added thereto.

The fuel holder 30 comprises a floor 32 which is inserted in recess 13 in spaced, substantially parallel relationship to the bottom 12A. As best shown in FIGS. 4 and 5, floor 32 has a planar surface portion 34 from which depend a plurality of peripherally spaced legs 36. When floor 32 is placed within recess 13 of the pan-shaped body, the distal end portions of legs 36 abut bottom 12A to support surface portion 34 of floor 32 in substantial paralellism with bottom 12A and to define with bottom 12A a chamber 38 for flow of combustion air and for receiving ash during use. The legs 36 may be formed as an integral part of floor 32 or be separate members secured in any suitable manner to the floor. The floor 32 has a multiplicity of holes 40 which serve to allow ash to fall into chamber 38 and air to flow upwardly therethrough and over the charcoal briquettes 15A which action improves the burning of the fuel. To further enhance fuel combustion, the floor 32 is provided with spaced arcuate cut-outs 42 along the periphery of the floor 32. The cut-outs 42 are particularly desirable where the floor 32 abuts along its periphery side wall 14A.

Figure 6:
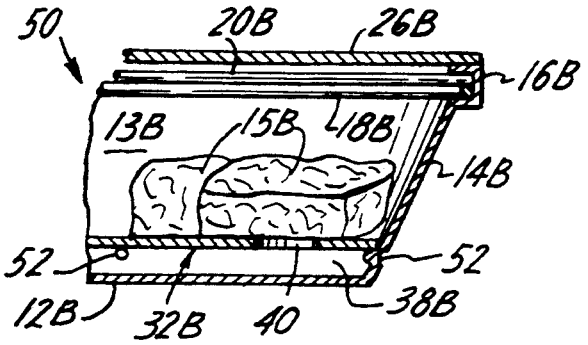
FIG. 6 is a fragmentary view in cross section similar to the views of FIGS. 2 and 4 showing a third embodiment of this invention.

In FIG. 6 is shown a fuel holder and fire pan assembly 50 (hereinafter referred to as "fuel holder") according to a third embodiment of this invention. The fuel holder 50 is essentially the same as fuel holder 30 except for an alternative floor member and the manner of supporting of the floor member. Accordingly, parts of fuel holder 50 corresponding to similar parts of fuel holder 30 will be designated by the same reference number with the suffix B added thereto.

The fuel holder 50, comprises a floor 32B which has no depending legs and is dimensioned and configured when inserted in recess 13 of the fuel holder, to substantially abut the inner surface of side wall 14B. To insure the support of floor 32B in spaced, parallel relationship to bottom 12B, a plurality of spaced dimples 52 are formed in side wall 14B to extend inwardly in to the recess. These dimples 52 engage the undersurface of floor 32B to support the latter in spaced relationship to bottom 12B. These dimples 52 are of particular importance when side wall 14B extends perpendicular to bottom 12B rather than slanted or sloped as shown. Also, when floors 32 and 32B are provided for a fuel holder having vertical side walls (not shown) rather than sloping walls as shown in FIGS. 4 and 6, and floors 32 and 32B are dimensioned and contoured to abut the inner surface of such vertical side walls, cut-outs 42 in floors 32 and 32B are particularly desirable.

It is now believed readily apparent that the present invention provides a prepackaged fuel holder and fire pan which provides a light-weight, compact and clean source of heat for cooking at picnics and the like. It is a fuel holder and fire pan which lends itself to stacking for ease in merchandising or storage. It is a fuel holder and fire pan that can be disposed of after use because it is relatively inexpensive and is capable of limited reuse.

It is to be understood that while the fuel holder and fire pan assembly according to this invention is shown as having a circular configuration, it may have any polygonal shape without departing from the scope of the invention. Additionally, floors 32 and 32B, may be disposed in recess 13 with or without being secured therein.

Accordingly, although several embodiments of the invention have been illustrated and described in detail, it is to be expressly understood that the invention is not limited thereto. Various other changes can be made in the arrangement of parts without departing from the spirit and scope of the invention as the same will be understood by those skilled in the art.

What is claimed is:

1. A prepackaged fuel holder and fire pan for use in picnic cooking comprising:

a) a body portion having a recess with fuel and defined by a bottom wall and contiguous peripheral wall; and b) a plurality of spaced wires disposed to extend in the same plane across said recess in spaced relationship with said bottom wall and intersecting each other adjacent their respective middle portions, c) each of the wires being connected at their respective opposite end portions to the peripheral wall means.

2. The pre-package apparatus of claim 1 wherein each of said wires extend diametrically across the top of said recess.

3. The apparatus of claim 1 wherein said recess has a heat reflective surface.

4. The prepackage apparatus of claim 1 wherein further a connecting means is provided to secure said wires together where they intersect each other.

5. The pre-package apparatus of claim 1 wherein further a removable cover is provided to close the recess when the fuel holder/fire pan is not in use.

6. The pre-package apparatus of claim 1 wherein further a connecting means is provided to secure said wires together at the intersection of the wires.

7. A prepackaged fuel holder and fire pan for picnic cooking comprising:

a) a body portion having a recess with fuel defined by a bottom wall and contiguous peripheral wall; and b) a floor member provided in said recess in spaced relationship with said bottom wall for supporting fuel in said recess and defining with the bottom wall a chamber;

c) said floor member having means communicating said chamber with the recess above said floor member;

d) a plurality of spaced wires connected at opposite ends to said peripheral wall and provided to extend diametrically across said recess.

8. The pre-package apparatus of claim 7 wherein said floor member has a peripheral edge portion and is dimensioned so that the peripheral edge portion abuts the peripheral wall means of the recess.

9. The pre-package apparatus of claim 8 wherein said peripheral edge portion has spaced cut-out portions so that the peripheral edge portion discontinuously abuts the peripheral wall.

10. The pre-package apparatus of claim 8 wherein said peripheral wall means has a plurality of spaced dimples therein extending into said recess and spaced from said bottom wall to support said floor member in spaced relationship to said bottom wall.

11. The pre-package apparatus of claim 7 wherein further a removable cover is provided to close the recess when the fuel holder and fire pan is not in use.

12. The apparatus of claim 7 wherein said floor member has at least three leg means depending from said floor member to engage said bottom wall for supporting said floor member in spaced relationship to the bottom wall.

* * * * *